US007901251B1

(12) United States Patent
Chen

(10) Patent No.: US 7,901,251 B1
(45) Date of Patent: Mar. 8, 2011

(54) AUDIO CONNECTOR

(75) Inventor: Chung-Yu Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/618,695

(22) Filed: Nov. 13, 2009

(51) Int. Cl.
*H01R 24/04* (2006.01)

(52) U.S. Cl. ..... 439/668; 439/669

(58) Field of Classification Search ..... 439/668, 439/669
See application file for complete search history.

(56) References Cited

U.S. PATENT DOCUMENTS 7,785,119 B1 * 8/2010 Chiang ..... 439/188
7,794,285 B1 * 9/2010 Huang ..... 439/668
2004/0029449 A1 * 2/2004 Liu ..... 439/668
2004/0242076 A1 * 12/2004 Nakai et al. ..... 439/668

* cited by examiner

*Primary Examiner* — Hien Vu
(74) *Attorney, Agent, or Firm* — Cheng-Ju Chiang

(57) ABSTRACT

An audio connector has a base. The base has a socket passing through a front end thereof. A rear end of the base has a rectangular ring holding trough communicating with the socket, surrounding a rectangular center block, each side of which has a notch passing through the rear end and communicating with the socket. A holding contact has a rectangular fixing frame which includes a base plate, two opposite side plates, a free plate extended from one of the side plates and spaced apart from the other side plate, fixed in the holding trough. A soldering slice is extended from a free end of the other side plate. Substantially middle portions of the base plate, the free plate and the side plates extend towards the same side to form two pairs of opposite contacting arms for projecting into the socket through the notches and clamping the plug symmetrically.

3 Claims, 4 Drawing Sheets

AUDIO CONNECTOR

BACKGROUND OF THE INVENTION

1. Field of the Invention

The present invention relates to an audio connector, and particularly to an audio connector capable of electrically connecting with an inserted plug firmly.

2. The Related Art

FIG. 5 is an assembled, perspective view of an audio connector in prior art. The audio connector includes an insulating housing l', a first contact 2' and a plurality of second contacts 3' mounted to the insulating housing 1'. The insulating housing 1' has a rectangular base 11', and a circular platform 12' protruded outwards from an end of the base 11'. The base 11' has a center socket 13' passing through the platform 12'. A plug 30' is inserted into the socket 13' from the platform 12'. A first contact recess 14' is formed at a side of the socket 13', away from the platform 12', for receiving the first contact 2'. A plurality of second contact recesses 15' are substantially arranged at two opposite sides of the socket 13' in a substantially symmetrical manner. The first contact 2' has a fixing slice 21' of U shape mounted in the first contact recess 14', a soldering slice 23' extending from one end of the fixing slice 21' and exposing outside the insulating housing 1' for being soldered to a circuit board (not shown), and a contact slice 22' of arc shape projecting into the socket 13' for resiliently connecting with the inserted plug 30'. The second contacts 3' are respectively accommodated in the second contact recesses 15' for electrically connecting with the inserted plug 30'.

When the plug 30' is inserted into the socket 13' through the platform 12', the second contacts 3' abut against the plug 30' elastically and symmetrically, but, the contact slice 22' pushes a side of a free end of the plug 30' to deflect toward an opposite side of the socket 13'. Consequently, the second contacts 3', which are located at the same side as the first contact 2', are unable to connect with the plug 30' stably and reliably. In addition, the second contacts 3', which are located at the side of the socket 13' opposite to the first contact 2', are extruded and pushed outwards by the deflective plug 30' so as to generate great deformation, which reduces the use time of the second contacts 3'.

SUMMARY OF THE INVENTION

Accordingly, an object of the present invention is to provide an audio connector capable of electrically connecting with a plug firmly. The audio connector has an insulating housing having a base. The base has a socket passing through a front end thereof for receiving the plug. A rear end of the base opposite to the front end has a holding trough of substantially rectangular ring shape and communicating with the socket, surrounding a center block of substantially rectangular shape. Each side of the center block has a notch which passes through the rear end and communicates with the socket. A plurality of conductive contacts is mounted to the insulating housing for electrically connecting with the inserted plug. A holding contact has a substantially rectangular fixing frame fixed in the holding trough. The fixing frame includes a base plate, two opposite side plates, a free plate facing to the base plate extended from one of the side plates and spaced apart from the other side plate. A soldering slice is extended from a free end of the other side plate. Substantially middle portions of the base plate, the free plate and the side plates extend towards the same side to form two pairs of opposite contacting arms for projecting into the socket through the corresponding notches and clamping a free end of the inserted plug resiliently and symmetrically.

As described above, since the contacting arms are arranged symmetrically, the forces acted on the plug from the contacting arms counteract each other, preventing the plug from deflecting with respect to a center axis of the socket. Accordingly, it avoids having influence on the connection stability between the plug and the conductive contacts, as mentioned in the conventional manner. Furthermore, such structure provides the stronger holding force for securing the inserted plug, improving the connection reliability therebetween.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
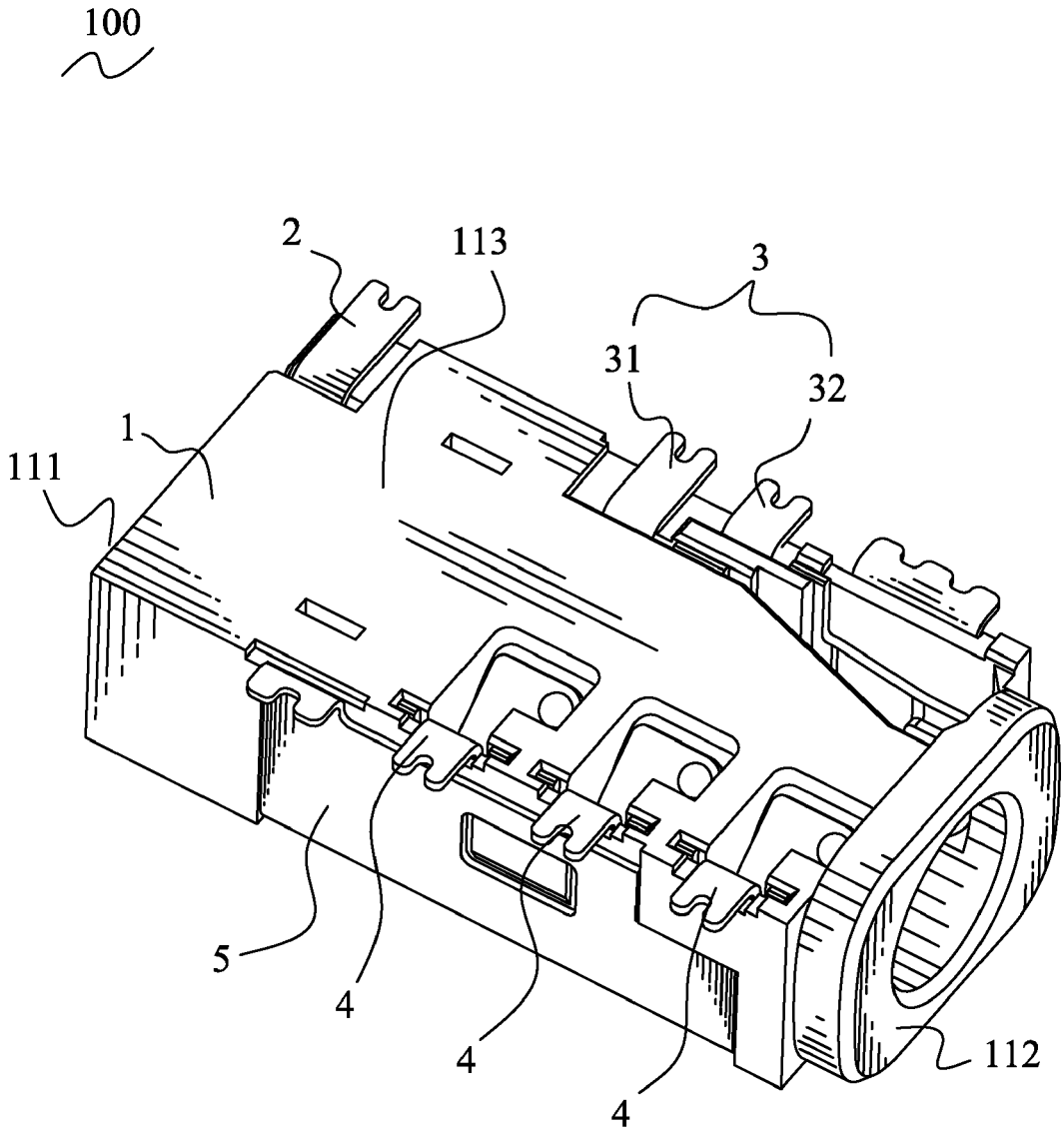
FIG. 1 is an assembled, perspective view of an audio connector of an embodiment in accordance with the present invention.

Referring to the drawings in greater detail, and first to FIG. 1, the embodiment of the invention is embodied in an audio connector 100. The audio connector 100 comprises an insulating housing 1, a plurality of contacts mounted to the insulating housing 1 and a shell 5 coupled with the insulating housing 1. The contacts include a holding contact 2, a set of switch contacts 3, and a plurality of conductive contacts 4. The switch contacts 3 include a resilient switch contact 31 and a stationary switch contact 32.

Figure 2:
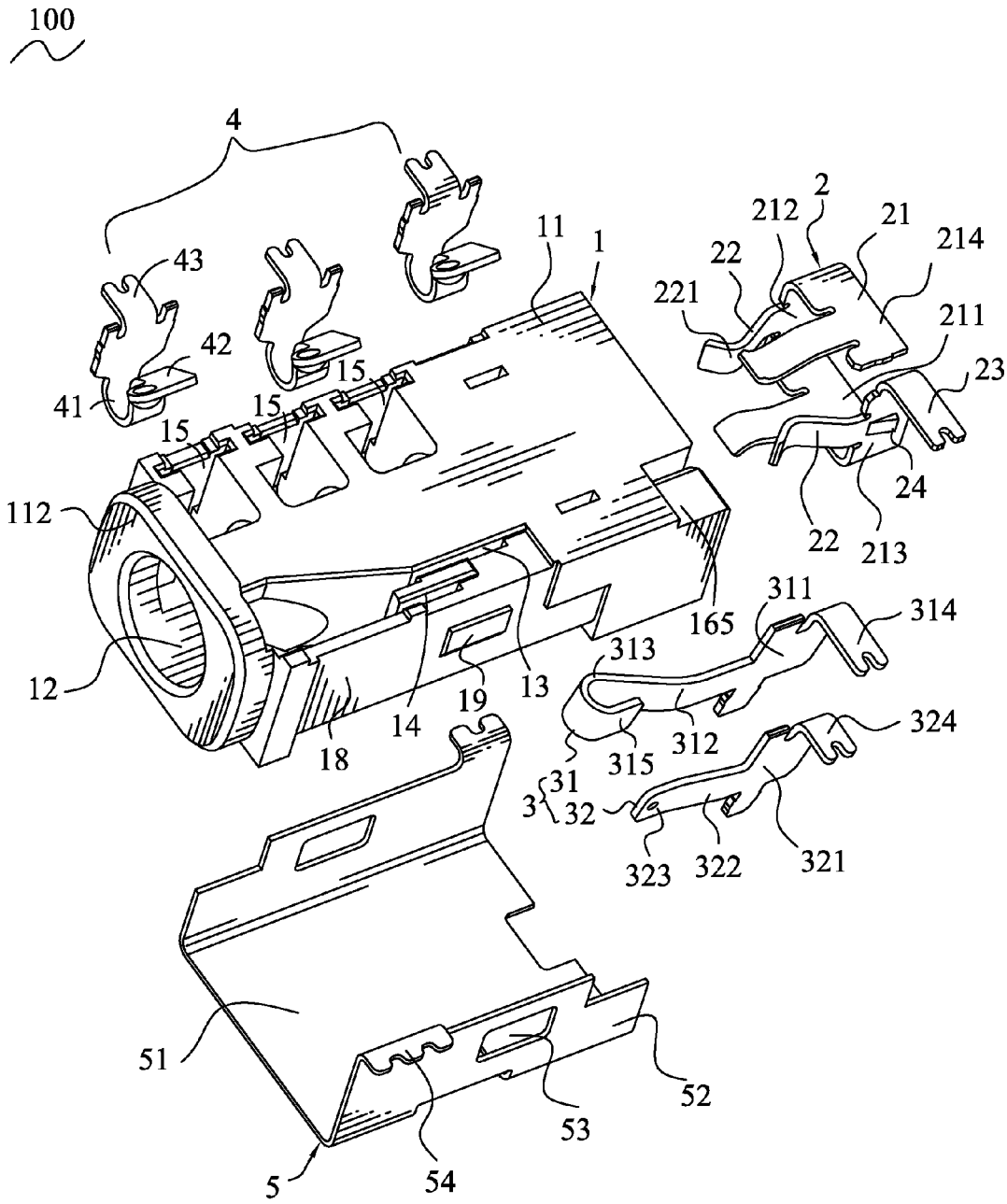
FIG. 2 is an exploded, perspective view of the audio connector shown in FIG. 1.
Figure 3:
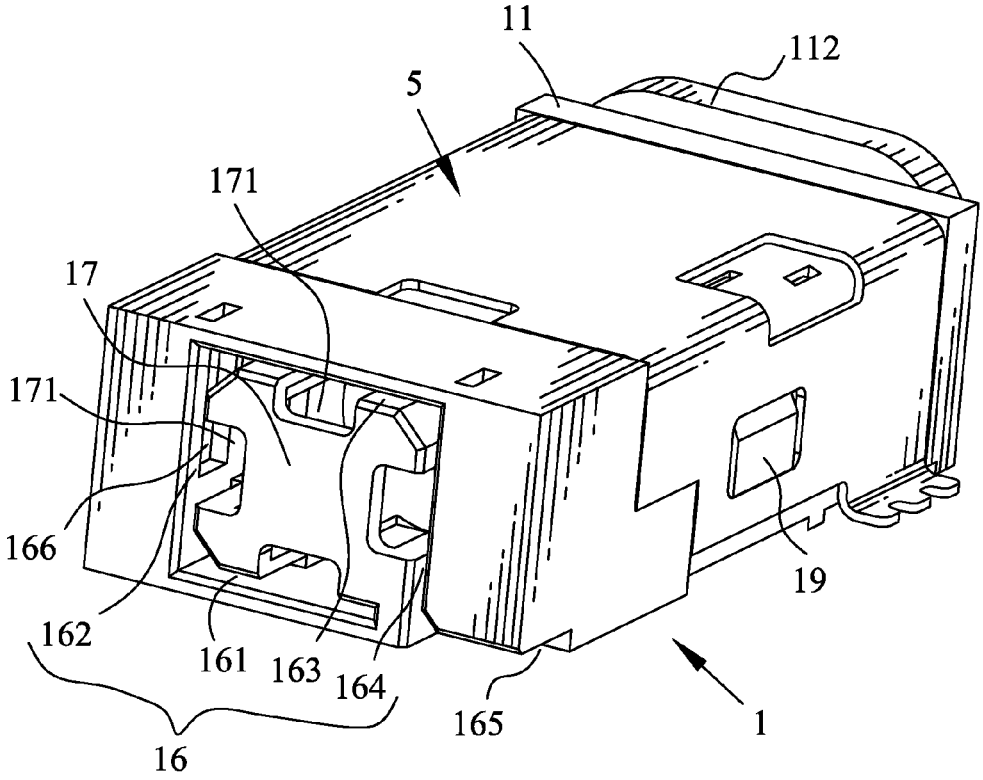
FIG. 3 is a perspective view of an insulating housing of the audio connector shown in FIG. 1 seen from another view, wherein a shell is assembled thereto.

Referring to FIGS. 1-3, the insulating housing 1 has a substantially rectangular base 11. The base 11 has a central socket 12. The socket 12 extends along a lengthways direction of the base 11 and passes through a front end 112 of the base 11. A rear end 111 of the base 11 opposite to the front end 112 is closed. In this embodiment, the front end 112 is shaped as a rectangular platform, and has four smooth corners.

A top surface 113 of the base 11 has a first groove 13 for receiving the resilient switch contact 31, a second groove 14 communicating with the first groove 13 for receiving the stationary switch contact 32, and a plurality of third grooves 15 for receiving the conductive contacts 4. The first groove 13 is arranged adjacent to the front end 112 and located at a side of the socket 12, with a first opening for intercommunicating with the socket 12 located adjacent to the front end 112. The second groove 14 is disposed at a side of the first groove 13 opposite to the socket 12, with a second opening for intercommunicating with the first groove 13 in alignment with the first opening. The third grooves 15 are disposed at an opposite side of the socket 12 and arranged in alignment with each other, forming a row abreast of the first groove 13. In this embodiment, there are three third grooves.

With reference to FIGS. 2-3, the rear end 111 has a holding trough 16 of substantially rectangular ring shape at middle thereof, surrounding a center block 17. The holding trough 16 has a first slot 161 extending parallel to and adjacent to the top surface 113, a second slot 162 extending perpendicularly from one end of the first slot 161, a third slot 163 abreast of the first slot 161 and communicating with one end of the second slot 162, and a fourth slot 164 extending perpendicularly from one end of the third slot 163 and passing through the top surface 113. The first slot 161 is spaced from the fourth slot 164 and has a closed end. Herein, a corner of the top surface 113 adjacent to the fourth slot 164 is formed with a receiving recess 165 communicating with the fourth slot 164. Each of the second and fourth slots 162, 164 has a buckling indentation 166 at a side facing the center block 17. The center block 17 is substantially rectangular. Each side of the center block 17 has a notch 171 at a substantial middle thereof. The notches 171 pass through the rear end 111 and communicate with the socket 12. The base 11 further has an indention area 18 at a bottom surface and two opposite lateral surfaces thereof, for receiving the shell 5. The indention area 18 located at the two opposite lateral surfaces of the base 11 have a buckling lump 19, respectively.

Referring to FIGS. 1-3, the holding contact 2, which may be manufactured by punching and bending a metal plate, has an open fixing frame 21 received in the holding trough 16, a plurality of contacting arms 22 symmetrically extending toward the same side from a side of the fixing frame 21, and a soldering slice 23 extending outwards from the fixing frame 21. The fixing frame 21 is rectangular and defines a base plate 211, two side plates 212, 213 extending perpendicularly from two free ends of the base plate 211, and a free plate 214 extending parallel to the base plate 211 from a free end of the side plate 212. The free plate 214 is spaced away from the side plate 213. A free end of the side plate 213 is prolonged opposite to the free plate 214 to form the soldering slice 23. Each of the side plates 212, 213 is formed with a buckling piece 24, corresponding to the buckling indentation 166. In assembly, the base plate 211, the side plates 212, 213 and the free plate 214 are respectively received in the third slot 163, the second slot 162, the fourth slot 164, and the first slot 161. The soldering slice 23 is received and exposes in the receiving recess 165 for being soldered to a circuit board (not shown). The buckling pieces 24 are buckled with the buckling indentations 166, respectively, for fixing the holding contact 2 to the insulating housing 1.

The contacting arms 22 are respectively extended forward from substantially middle portions of front sides of the base plate 211, the side plates 212, 213 and the free plate 214. Each pair of the facing contacting arms 22 have free ends arched toward each other to form contact portions 221, for holding an inserted plug 6 (shown in FIG. 4) symmetrically and firmly.

Figure 4:
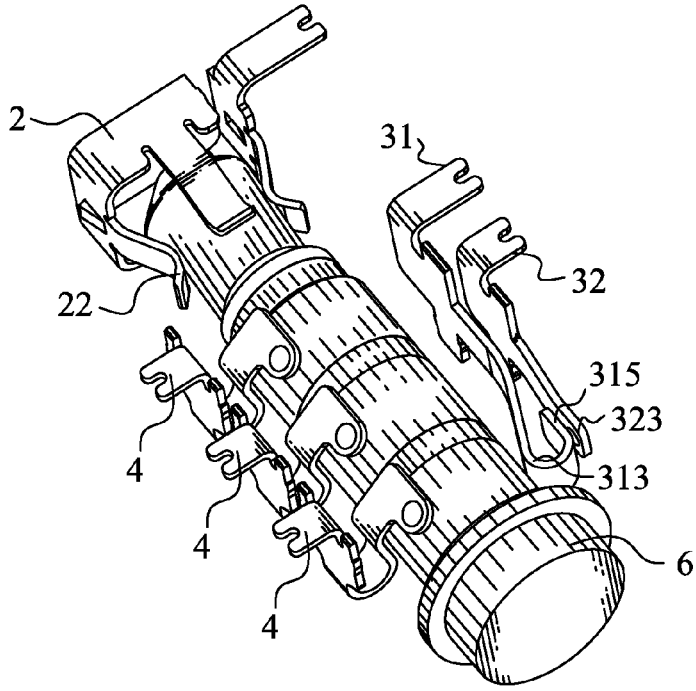
FIG. 4 is a schematic view illustrating the electrical connection between the audio connector of FIG. 1 and a mating plug, wherein the insulating housing of the audio connector is removed.
Figure 5:
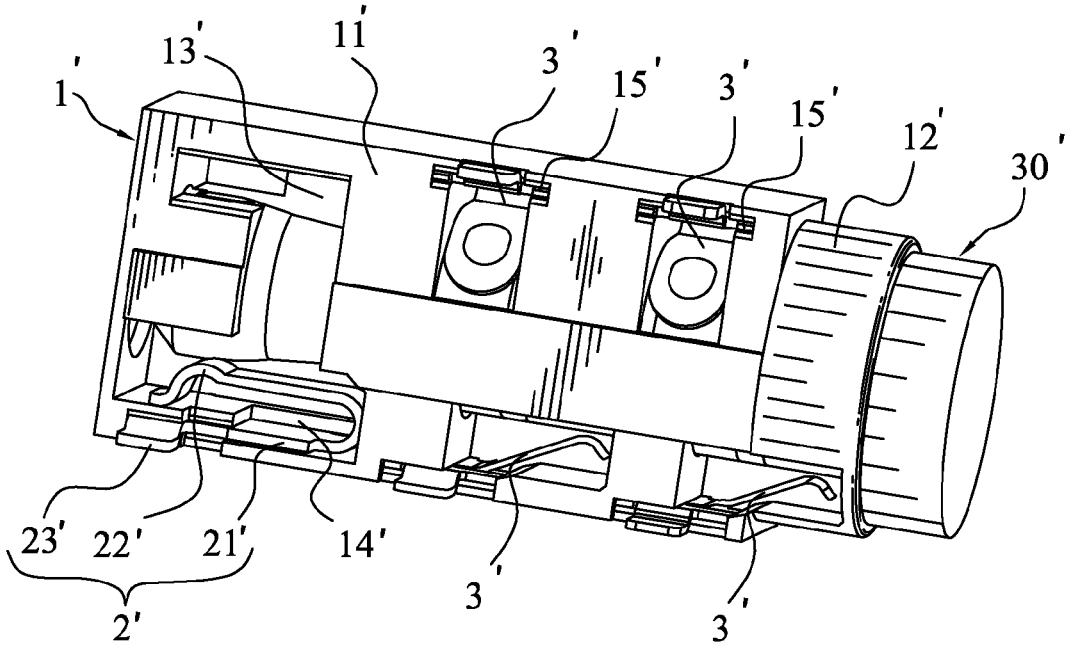
FIG. 5 (Prior Art)
FIG. 5 is an assembled, perspective view of an audio connector in prior art.

Referring to FIGS. 1-2 and FIG. 4, the resilient switch contact 31 has a first holding slice 311 received in the first groove 13 for fixing the resilient switch contact 31. A resilient arm 312 is extended frontward from a lower portion of a front edge of the first holding slice 311, and deflects from a plane of the first holding slice 311 for projecting into the socket 12 through the first opening. The resilient arm 312 has a free end formed with a substantially U shape, with a narrower opening facing to the first holding slice 311, named as connecting portion 313. A free portion of the connecting portion 313 is defined as a pressing pad 315, substantially in alignment with the first holding slice 311. The connecting portion 313 partially projects in the socket 12 for smoothly abutting against the inserted plug 6. A top edge of the first holding slice 311 is extended perpendicular to the first holding slice 311 to form a soldering slice 314. The soldering slice 314 and the resilient arm 312 are substantially disposed at two opposite sides of the plane of the first holding slice 311. In this embodiment, the soldering slice 314 is located at a rear end of the top edge of the first holding slice 311, away from the resilient arm 312. In assembly, the soldering slice 314 exposes outside the top surface 113 of the insulating housing 1 for being soldered to the circuit board.

The stationary switch contact 32 is received in the second groove 14 and has a second holding slice 321. A front side of the second holding slice 321 has a lower portion stretched frontward to form a resting arm 322. The resting arm 322 defines a resting end 323 which faces and is spaced from the pressing pad 315, when the plug 6 is not inserted into the socket 12. The second holding slice 321 has a soldering slice 324, which is substantially analogue to the soldering slice 314, extended perpendicularly from a top edge thereof and exposes outside the top surface 113, abreast of the soldering slice 314.

Referring to FIGS. 2-4, the conductive contacts 4 are respectively received in the third grooves 15. Each of the conductive contacts 4 has a fixing portion 41 of substantially U shape, a contacting slice 42 and a soldering slice 43 extended opposite to each other from two free ends of the fixing portion 41. The soldering slices 43 expose outside the top surface 113 of the insulating housing 1 for being soldered to the circuit board. The contacting slices 42 protrude into the socket 12 for electrically connecting with the inserted plug 6. The shell 5, which is received in the indention area 18, has a rectangular basic plate 51 and two lateral plates 52 extended perpendicularly from two opposite sides of the basic plate 51. Each of the lateral plates 52 has a buckling opening 53, corresponding to the buckling lump 19 for fixing the shell 5 to the insulating housing 1, and a soldering slice 54 extended perpendicularly and outwardly from a top edge thereof, for being soldered to the circuit board.

Referring to FIG. 4, when the plug 6 is inserted into the socket 12, the connecting portion 313 is elastically extruded so that the pressing pad 315 connects with the resting end 323, thereby achieving the electrical connection between the resilient switch contact 31 and the stationary switch contact 32. The contacting slices 42 resiliently abut against an outer surface of the inserted plug 6. A distal end of the inserted plug 6 is inserted among the contacting arms 22 and resiliently clamped by the contact portions 221 in a symmetrical manner.

As described above, since the contacting arms 22 are arranged symmetrically, the forces acted on the plug 6 from the contact portion 221 counteract each other, preventing the plug 6 from deflecting with respect to a center axis of the socket 12. Therefore, such structure avoids affecting the connection stability between the plug 6 and the switch contacts 3, and the conductive contacts 4, furthermore, provides the stronger holding force for securing the inserted plug 6, improving the connection reliability therebetween. In addition, the holding trough 16 is located at the rear end 111 of the base 11, without formed at the side of the socket 12 according to the conventional manner, which decreases the possibility that the unexpected substance reach the circuit board where the contacts of the audio connector 100 are soldered, through the socket and the grooves, resulting short circuit.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio connector for receiving a plug, comprising:

an insulating housing having a base, the base having a socket passing through a front end thereof for receiving the plug, a rear end of the base opposite to the front end having a holding trough of substantially rectangular ring shape and communicating with the socket, the holding trough surrounding a center block of substantially rectangular shape, each side of the center block having a notch which passes through the rear end and communicates with the socket;

a plurality of conductive contacts mounted to the insulating housing for electrically connecting with the inserted plug; and a holding contact, the holding contact having a substantially rectangular fixing frame fixed in the holding trough, the holding contact including a base plate, two opposite side plates, a free plate facing the base plate extended from one of the side plates and spaced apart from the other side plate, a soldering slice extended from a free end of the other side plate, substantially middle portions of the base plate, the free plate and the side plates extending towards the same side to form two pairs of opposite contacting arms for projecting into the socket through the corresponding notches and clamping a flee end of the inserted plug resiliently and symmetrically;

wherein the holding trough includes a first slot, a third slot parallel to the first slot, a second slot connecting corresponding ends of the first slot and the third slot, and a fourth slot parallel to the second slot, one end of the fourth slot is connected with an opposite end of the third slot, the other end of the fourth slot is extended to pass through the base, the first slot is spaced apart from the fourth slot; and wherein sides of the second slot and the fourth slot facing the center block are formed with buckling indentions for buckling with buckling pieces formed at the two side plates.

2. The audio connector as claimed in claim 1, wherein a corner of the base adjacent to the other end of the fourth slot defines a receiving recess, for receiving and exposing the soldering slice extended opposite to the free plate from the corresponding side plate.

3. The audio connector as claimed in claim 1, wherein a free end of the contacting arm is arched inward to form a contact portion for being against the plug.

* * * * *